United States Patent [19]

Carnahan

[11] 4,003,430

[45] Jan. 18, 1977

[54] APPARATUS FOR THE REPLACEMENT OF SEALS IN A WELL RAM TYPE BLOW OUT PREVENTER

[76] Inventor: David A. Carnahan, Garricks House, Hampton Court Road, Hampton, Middlesex, England

[22] Filed: Dec. 26, 1974

[21] Appl. No.: 536,312

[30] Foreign Application Priority Data

Jan. 2, 1974 United Kingdom ..... 134/74

[52] U.S. Cl. ..... 166/85; 29/235; 29/451; 166/55.8; 277/9.5

[51] Int. Cl.[2] ..... E21B 33/06

[58] Field of Search ..... 251/1; 166/77.5, 85, 166/315, 250, 277; 277/9, 9.5, 11, 126, 127, 129; 137/315, 326–328; 29/235, 451

[56] References Cited

UNITED STATES PATENTS

| | | | |
|---|---|---|---|
| 3,272,222 | 9/1966 | Allen | 277/127 X |
| 3,583,480 | 6/1971 | Regan | 166/.5 |
| 3,737,974 | 6/1973 | Mott | 29/401 |
| 3,821,838 | 7/1974 | Mott | 29/200 D |

*Primary Examiner*—Alan Cohan
*Assistant Examiner*—Richard Gerard
*Attorney, Agent, or Firm*—Fleit & Jacobson

[57] ABSTRACT

This invention relates to the replacement of seals in ram type blow out preventers and is especially useful for replacing such seals where the well head is at a considerable distance from the drill head, for example on the sea bed. The method comprises removing a seal from a first blow out preventer ram in situ at the lower end of the well riser, and inserting a replacement shoe of smaller internal diameter itself fitted with a seal within the seal recess of the first ram.

There is disclosed a shoe for a ram type blow out preventer comprising a part annular member having a part cylindrical outer surface provided with a ridge for receipt in a recess in a blow out preventer ram, means for indexing and securing the part annular member relative to the blow out preventer ram, and a seal receiving recess in the radially inner surface of the part annular member.

The invention also relates to apparatus for indexing and mounting a blow out preventer receiving shoe on a blow out preventer ram and to apparatus for cutting a seal from a ram to leave a recess for the receipt of a shoe.

10 Claims, 17 Drawing Figures

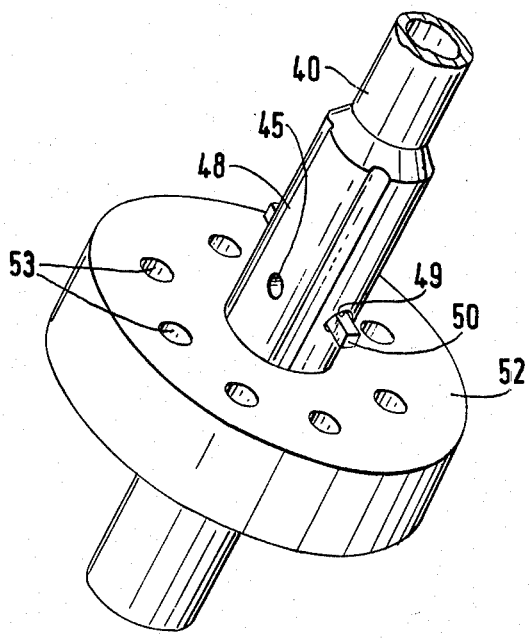
FIG. 14.
FIG. 17.
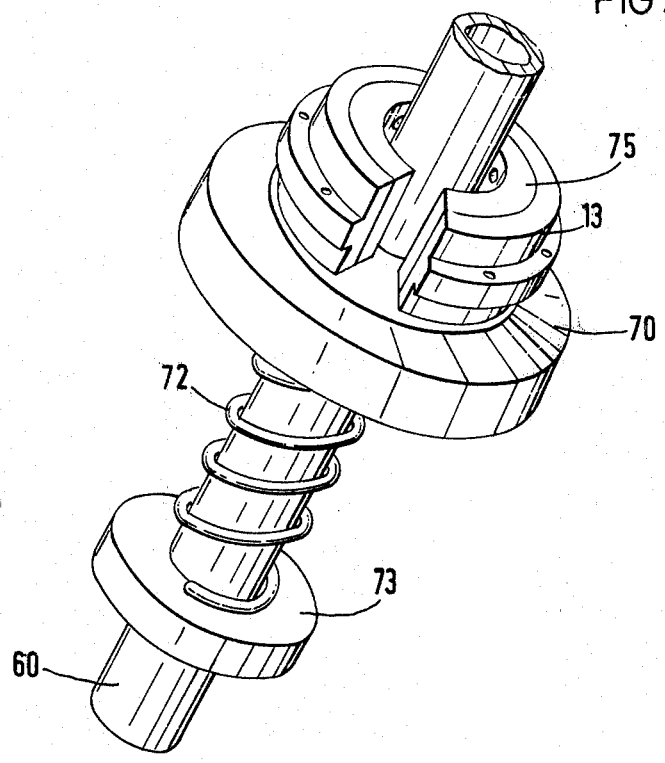

APPARATUS FOR THE REPLACEMENT OF SEALS IN A WELL RAM TYPE BLOW OUT PREVENTER

This invention relates to the location of apparatus in a well head and is more especially concerned with the replacement of seals in ram type blow out preventers and is especially useful for replacing such seals where the well head is at a considerable distance from the drill head, for example on the sea bed. Thus with advent of off-shore drilling under more difficult conditions in deeper water it becomes necessary or desirable during drilling to change the rams of a ram type blow out preventer located at a considerable and inaccessible distance from the drilling platform of the drilling rig.

Such a change is necessary or desirable as the diameter of the drill pipe is changed, it being necessary successfully to drill pipe of reducing diameter or as progressively reduced casing sizes are installed as the depth of the drilling increases. Ram type blow out preventers are normally provided near the lower end of the riser at the well head above the well casing and comprise rams provided with semi-cylindrical sealing surfaces which can be forced by hydraulic pressure against the periphery of the drill pipe or casing to permit passage of the pipe therethrough while at the same time providing a reliable seal against blow out. The present invention is based upon the idea that instead of replacing the rams themselves replaceable shoes are provided for mounting on the rams for engagement with the pipe.

According to a broad aspect of the invention there is provided a method of positioning apparatus in a well head which comprises positioning the apparatus vertically in the well head by engagement of a radically projecting flange of the apparatus with an end surface of a blow out preventer and indexing the apparatus rotationally until an indexing member thereof is received within an axially extending space defined between facing surfaces of a ram. A related aspect of the invention provides apparatus for working in a well head, such apparatus comprising a support body, means for suspending the support body from a pipe string, a flange projecting radially from the support body for engagement with an end surface of a blow out preventer, and means carried by the body and spring urged from a retracted position to an extended position whereby, in use of the apparatus, following axial location thereof in a well head by engagement of the flange with a blow out preventer the apparatus can be roatated until such time as the means carried by the body is aligned to be received within an indexing space extending axially of the ram.

According to another aspect of the invention there is provided a method of replacing a seal in a ram type blow out preventer which comprises removing a seal from a first blow out preventer ram in situ at the lower end of the well riser, and inserting a replacement shoe of smaller internal diameter itself fitted with a seal within the seal recess of the first ram. It wll be appreciated that the first ram may itself be replaceable shoe or may in fact be the working face of the blow out preventer ram itself.

With reducing diameters of well pipe a third shoe may be used to replace the seal in a second shoe and the same procedure may be repeated subsequently as many times as reductions in diameter of the well pipe are required. Alternatively a third shoe may be used to replace the second shoe in its entirety.

The succeeding shoes may conveniently be pinned in location in the previously installed shoe recesses and such pins may be provided to extend in directions both radially and axially of the direction of extent of the well pipe.

A further aspect of the invention provides a shoe for a ram type blow out preventer comprising a part annular member having a part cylindrical outer surface provided with a ridge for receipt in a recess of a blow out preventer ram, means for indexing and securing the part annular member relative to the blow out preventer ram, and a seal receiving recess in the radially inner surface of the part annular member. Preferably the indexing means comprises tapered orientation projections for receipt in correspondingly tapered recesses in the blow out preventer ram. The securing means may comprise pin receiving holes for receipt of pins therethrough to engage holes in the blow out preventer ram. Such pin receiving holes may extend either radially or both radially and axially of the shoe.

Yet another aspect of the invention provides apparatus for indexing and mounting a blow out preventer receiving shoe on a blow out preventer ram, such apparatus comprisng an installation body adapted to be secured to the lower end of a drill pipe string, means for supporting a replacement shoe in a predetermined position on the body, means carried by the installation body for indexing the shoe support means relative to a drill pipe ram grip during use of the apparatus, and means for engaging the replacement shoe with a blow out preventer ram. Conveniently the indexing means may comprise an indexing assembly including stubs adapted to be received between the ends of the rams of a drill pipe ram grip in their indexing position. Spring biasing means may be provided urging the stubs axially towards their indexing position.

The supporting means may comprise a tray member carried by the installation body, the shoe being securable thereto by shear pins or other releasable means. Suitably the tray may have a sloping support surface adapted to cam the tray axially downwardly upon engagement by a blow out preventer ram upon radial movement of the ram inwards towards the shoe.

Preferably the installation body is provided with a tapered surface for driving securing pins radially outwardly through the shoe into holes in the blow out preventer ram upon axial movement of the installation body relative to the shoe. The installation body may be provided with means for supporting securing pins axially for receipt in holes extending axially through the shoe and blow out preventer ram.

A basket may be mounted on a drill pipe below the body for collecting shoe or any other components accidentially dropped from the installation assembly during use thereof.

A related aspect of the invention provides a cutter apparatus for removing a seal from a blow out preventer ram comprisng a cutter body, means on the cutter body for locating it relative to a drill pipe ram grip, cutter blades movable outwardly from the body for engagement with a seal, and means for so moving the blades. Suitably the means for moving the blades may comprise a tapered hydraulic piston displaceable axially to force the cutter blades radially outwardly from the cutter body. Collection ports may be provided in a positioning ring below the cutter blades for collecting seal debris removed from a blow out preventer ram by use of the cutter blades.

The invention will be further described, by way of example, with reference to the accompanying drawings, in which.

Figure 11:
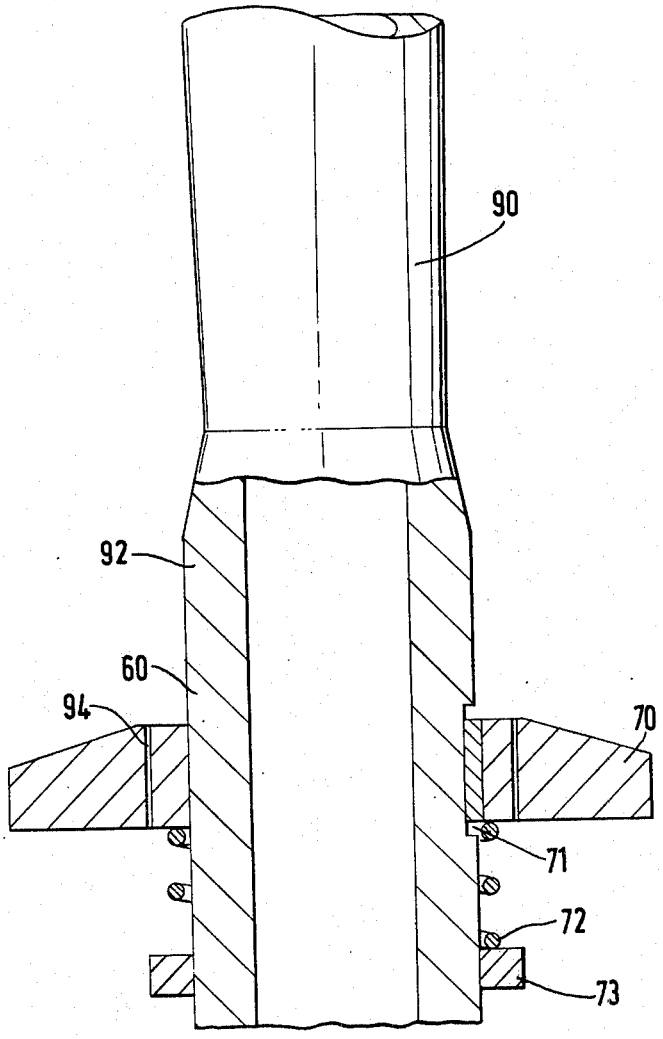
FIG. 11 is a further enlarged sectional detail of the apparatus of FIG. 8.
Figure 12:
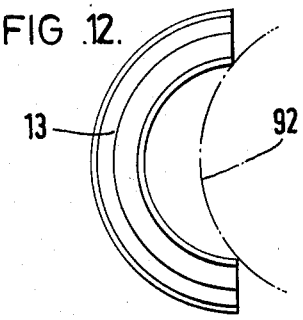
Figure 13:
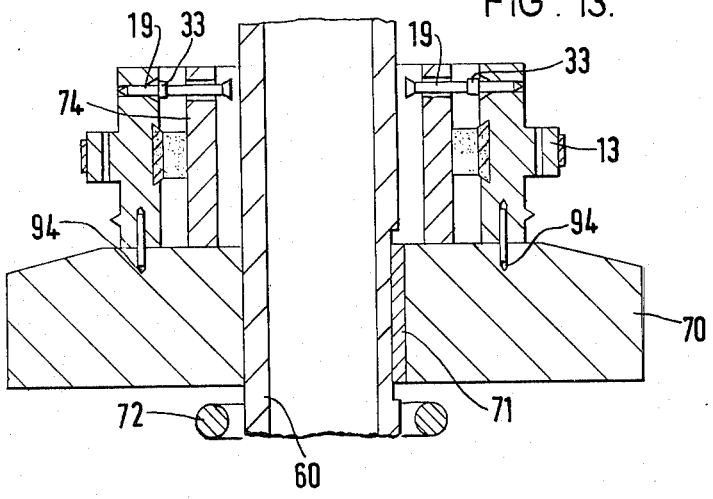
Figure 16:
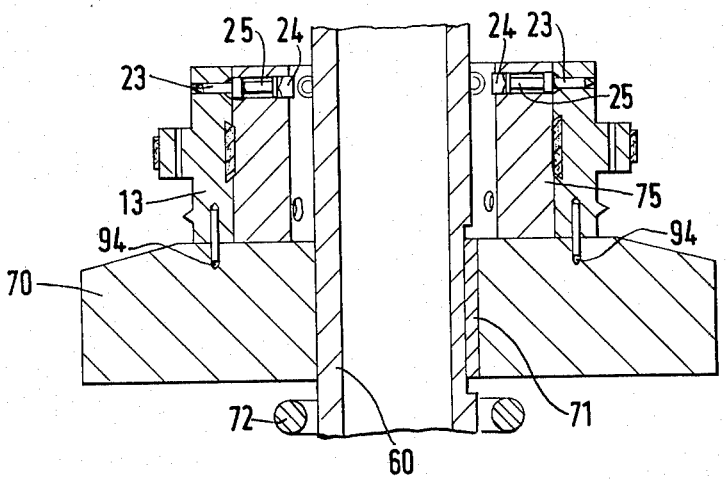
Figure 15:
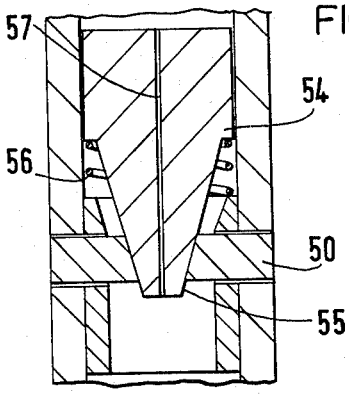

FIG. 12 diagrammatically illustrates the relationship between a replacement shoe and the diameter of part of the apparatus of FIG. 11;

FIG. 13 is a cross sectional detailed view of a shoe mounted on a modified installation assembly where a shoe compression ring is used to support the shoe during fitting to a ram;

FIG. 14 is a perspective view of part of a modified form of cutter;

FIG. 15 is a detailed sectional view of part of the cutter of FIG. 14;

FIG. 16 is a view similar to FIG. 11 but showing a further modified means supporting shoes for mounting on rams; and FIG. 17 is a perspective view of the assembly of FIG. 16.

Figure 1:
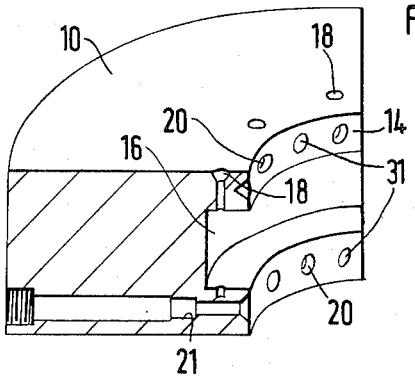
FIG. 1 is a sectioned perspective view of part of a blow out preventer ram with which the present invention is usable.

Referring to the drawings, FIG. 1 is a sectioned perspective view of part of a blow ot preventer ram 10. The ram is in the form of half of a cylindrical annulus with a semi-cylindrical inner surface 14 provided with a seal receiving recess 16. Provided in the surface 14 are a plurality of conical orientation recesses 31 and a plurality of locking pin holes 20 alternating with the orientation recesses 31. Shoe securing pin holes 18 extend axially from the top surface of the ram 10 to intersect the recess 16. During normal use of the ram as first installed at the well head a seal packing (not shown) is received within the recess 16 to project radially inwardly slightly beyond the surface 14 so that in use of the ram the seal can be pushed against a cylindrical pipe for providing a seal against blow out axially along the outer surface of the pipe.

Figure 6:
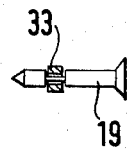
FIG. 6 is an elevational view of a locking pin for securing the shoe of the ram.
Figure 3:
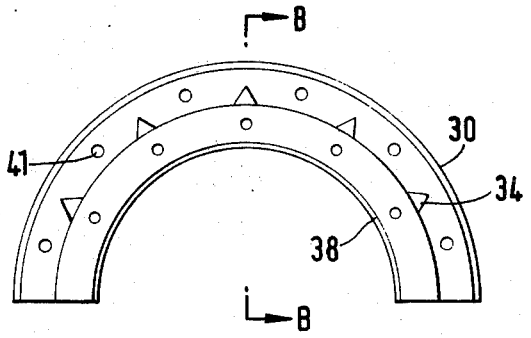
FIG. 3 is a top plan view of the shoe of FIG. 2.
Figure 4:
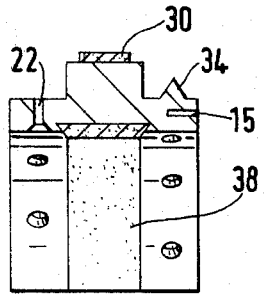
FIG. 4 is a section taken along the line B—B of FIG. 3.
Figure 5:
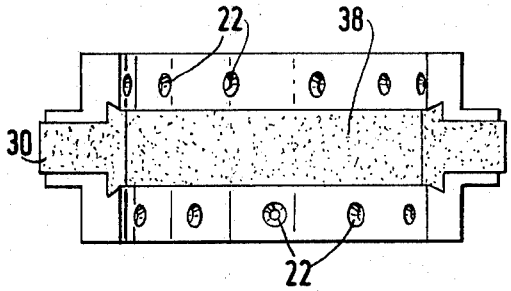
FIG. 5 is a front elevational view of the shoe of FIG. 2.

FIGS. 2 to 5 illustrate a replacement shoe 13 which can be mounted to the inner face 20 of the ram 10 using locking pins 19 as illustrated in FIG. 6. The replacement shoe 13 is part annular in form having a semi-cylindrical outer surface 32 provided with a projecting ridge 36 adapted to be received within the recess 16 of the ram. The ridge 36 has provided on its outer surface a layer of packer material 30 to provide a seal between the shoe and the ram. On the surface 32 there are provided a plurality of projecting conical orientation points 34 adapted for receipt in the tapered recesses 31 of the ram for indexing the shoe relative to the ram. Alternating with the orientation projections 34 are a plurality of locking pin holes 22 extending through the shoe for alignment with the locking pin holes 20 in the ram when the shoe is mounted thereon. In a recess at the inner face of the shoe 13 there is provided packing material 38 for engagement with the drill pipe, casing or tubing during use of the shoe mounted on a ram. As can be seen in FIG. 1 the locking pin holes 20 are provided with a larger diameter counterbore 21 therein whereby a locking pin 19 as illustrated in FIG. 6 when passed through a hole 22 to retain the shoe in position, is received within the locking pin hole 20 with an expansible snap ring 33 expanding to engage behind the shoulder formed by the counterbore 21 within the locking pin hole 20. Accordingly when a replacement shoe is simply forced against the ram 10 final indexing can take place through action of the orientation projections 34 engaging the recesses 31 and at a later stage the locking pins 19, carried by the replacement shoe 13, can be thrust home into the locking pin holes 20, the snap rings 33 being forced by contract by a countersunk entrance to each of the holes 20, full engagement taking place once the snap rings 33 expand within the counterbore 21. A shoe compressing ring 74 may be provided within the shoe 13 as shown in FIG. 13. Also provided in the ridge 36 are a plurality of axially extending security pin holes 41 which can be engaged by axially extending pins passed through the securing pin holes 18 of the ram.

Figure 7:
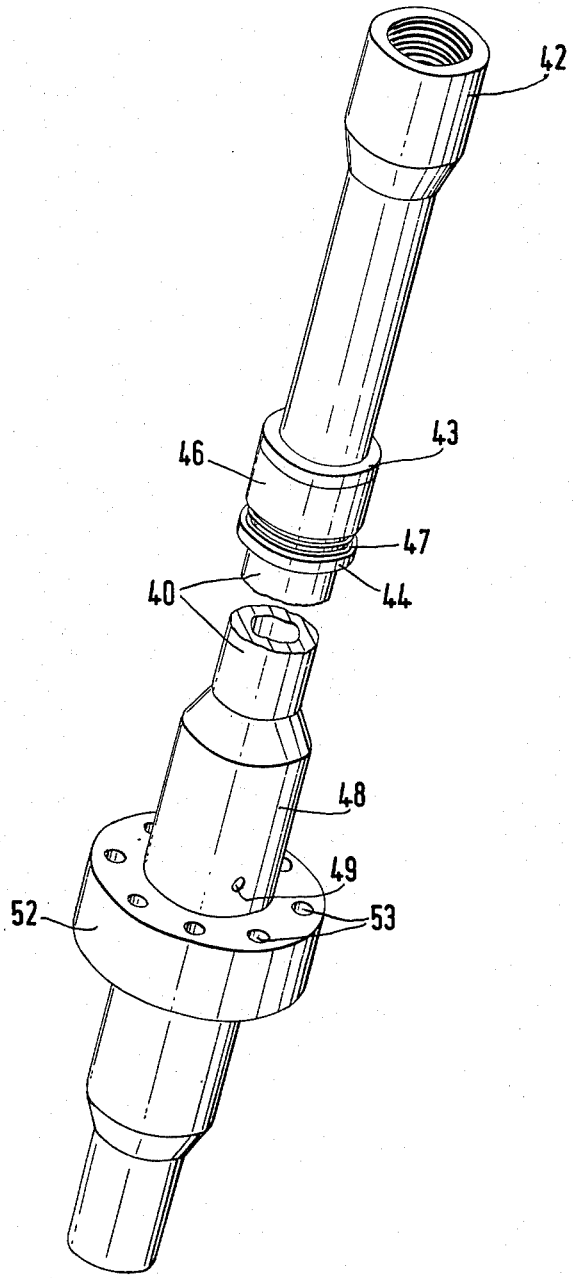
FIG. 7 is a broken away perspective view of a cutter apparatus for removing the seal from a blow out preventer ram.

As will be appreciated, before the shoe 13 can be installed in the ram 10 the seal or packing initially within the recess 16 of the ram 10 must be removed. FIG. 7 is a perspective view of a cutter assembly for removing the seal from such a recess 16. The cutting assembly comprises a cutter body 40 provided at its upper end with a connector 42 for connection to the lower end of a drill pipe. Secured to the cutter body 40 are two rings 43 and 44, the upper ring 43 acting as a locator for a drill pipe ram grip 46 and the lower ring 44 acting as a stop for a spring 47 which urges the ram grip 46 towards the locator ring 43. At the lower end of the cutter body 40 there is provided a cutter housing 48 provided with apertures 49 therethrough through which cutter blades 50 can project during use of the cutters. Preferably, as shown in FIGS. 14 and 15, also provided are flushing ports 45 through which a fluid may be passed to carry away cuttings. With the embodiment of FIG. 14 the cutter body 40 is shown provided with a fluted exterior surface to facilitate the flushing action of fluid from the ports 45. Beneath the apertures 49 there is provided a projecting positioning ring 52 containing a number of collection ports 53 extending axially and closed at their bottom ends by perforated strainers 51 as illustrated in FIG. 9.

Figure 9:
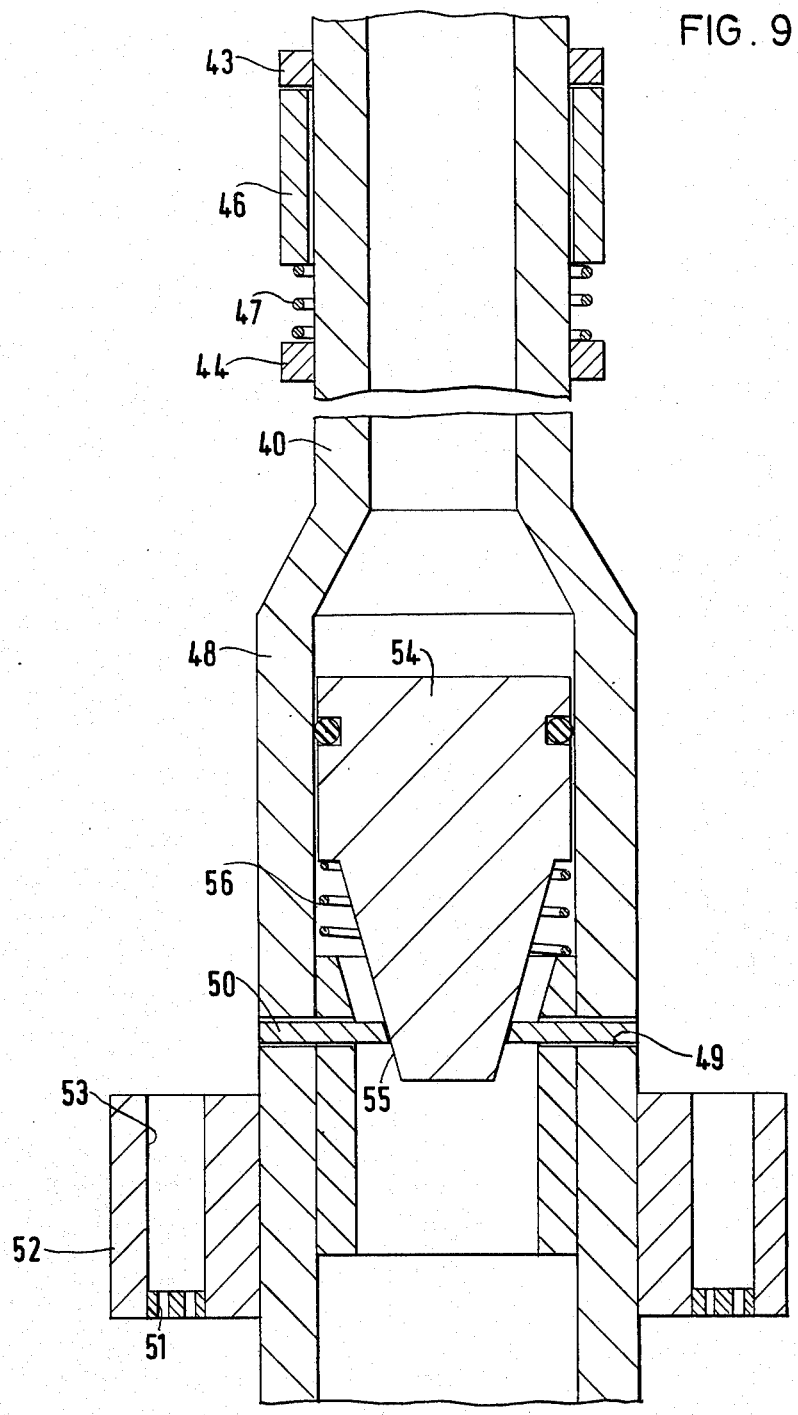
FIG. 9 is an enlarged sectional view of a detal of the cutter assembly of FIG. 7.

Referring to FIG. 9 there can be seen within the housing 48 a piston 54 provided at its lower end with a tapered cam surface 55 engaging the inner ends of cutter blades 50. The piston is urged upwardly as shown in FIG. 9 by spring 56 whereby upon hydraulic pressure being exerted within the interior of the cutter body the piston 54 is displace downwardly against the action of the spring 56 with the tapered surface 55 camming the blades 50 radially outwardly to project from the outer surface of the housing 48. With the construction of FIGS. 14 and 15 the hydraulic fluid also passes through the flushing fluid passage 57 and out from the flushing ports 45 to remove cuttings from the seal receiving recess 16.

During use of this cutter assembly to remove a seal from the recess 16 of the ram 10 the assembly is lowered until it is positioned with the ram grip 46 aligned with gripping rams at the well head. Upon operation of the gripping rams the ram grip 46 is engaged to support the cutter body vertically with the locator 43 resting upon the top of ram grip 46. Sufficient clearance is left within the ram grip 46 for the cutter body 40 to be rotatable relative thereto when the ram grip is gripped at the well head. The length of the cutter body 40 is such that when so located with the ram grip 46 gripped by the gripping rams the cutters 50 are at the same height as the recess 16 within the blow out preventer ram 10. Hydraulic pressure can now be applied down the drill pipe to force the piston 54 downwardly to cause the cutter blades 50 to extend radially outwardly from the ports 49 at the same time as the cutter assembly is slowly rotated by its drill pipe while being supported by the grip locator ring 43 resting on the ram grip 46. The cutter blades 50 during such slow rotation cut the seal or packing from within the recess 16 with the bits of packing being flushed by fluid injected outside the drill pipe, or from the flushing ports 45 as the case may be, into the collection ports 53 where the fluid is able to pass through the restricted openings at the bottom of the collection port leaving the mass of debris from the cut out seal within the collection ports. Following completion of the cutting operation upon extraction of the cutter assembly from the well it can readily be checked whether the seal removal operation has been successful by inspecting the debris collected within the collection ports 53.

Figure 10:
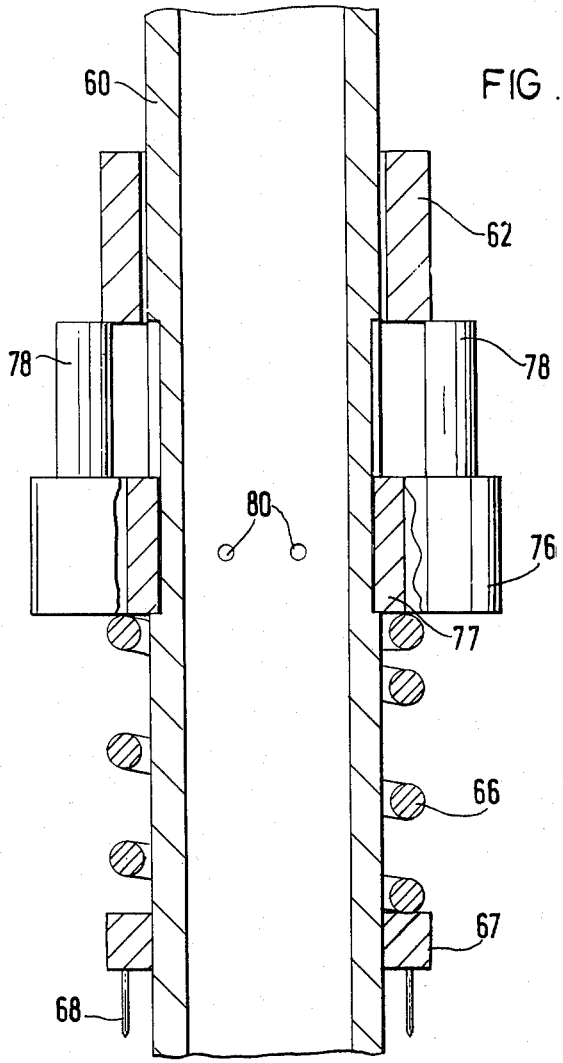
FIG. 10 is a sectional view of detail of the orientation assembly of the apparatus of FIG. 8.
Figure 2:
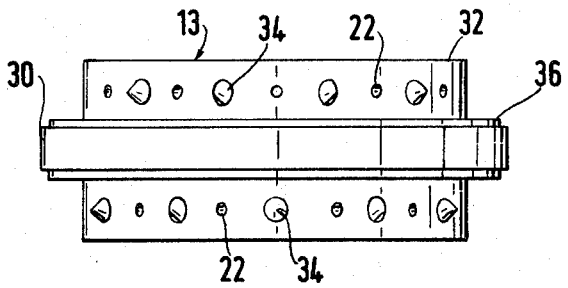
FIG. 2 is a rear elevational view of a sealing shoe according to the invention.
Figure 8:
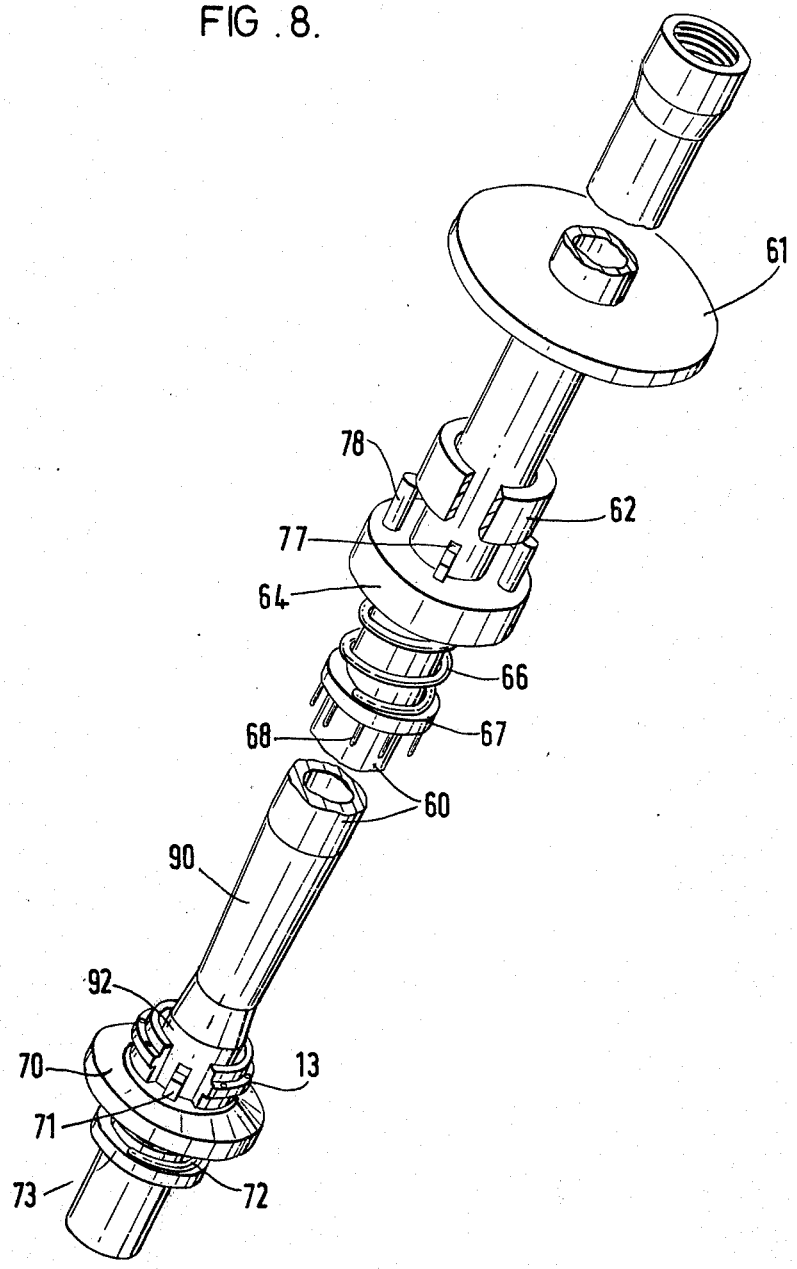
FIG. 8 is a perspective view of the installation apparatus according to the invention for installing a sealing shoe in a blow out preventer ram.

Referring to FIG. 8 there is shown a ram shoe installation assembly comprising an installation body 60 provided at its upper end with a connection for connecting to the lower end of a drill pipe. Mounted near the top of the body 60 is an annular blow out preventer rest 61 and below this is a drill pipe ram grip 62. Immediately below the drill pipe ram grip 62 there is provided an indexing assembly 64 which is slidable axially of the installation body 60 as will be explained in connection with FIG. 10. The indexing assembly 64 is urged upwardly by a compression spring 66 engaging a spring stop 67 carried by the body 60. Shoe securing pins 68 are illustrated in FIG. 8 and FIG. 10 as secured to the spring stop ring 67 to project downwardly axially of the installation body 60. At the lower end of the installation body 60 there is provided a shoe supporting tray 70 adapted to support a pair of replacement shoes 13 as shown. The tray 70 is keyed by a key way 71 for axial movement relative to the installation body 60 and is biased upwardly by a spring 72 supported by a tray positioner ring 73 mounted to the body 60.

Referring to FIG. 10, the indexing assembly 64 comprises an indexing ring 76 keyed at 77 for sliding movement axially of the installation body 60. Two indexing stubs 78 are provided to project upwardly from the ring 76 on diametrically opposed sides thereof and are normally prevented from upward movement by engagement with the under surface of the expanded drill pipe ram grip 62. Signal ports 80 extending from the interior to the exterior of the installation body 60 are closed by the ring 76 when the rings is in its lower position relative to the body 60 as illustrated in FIG. 10.

At the lower end of the installation body 60 there is provided a larger diameter portion having a cylindrical surface 92 which has a larger radius of curvature then the internal surface of the replacement shoe 13 to be installed by the assembly. Carried for limited axial movement on the larger diameter portion of the installation body there is provided the tray 70 keyed for such axial movement at 71. The tray 70 is biased upwardly by the spring 72 engaging the ring 73. Above the larger diameter portion there is a neck provided thereabove with a tapered surface 90 for driving home shoe locking pins 19 in a manner to be described.

In order to install a pair of replacement shoes 13 the cutter assembly is first lowered into the well head until the spring loaded positioning ring 52 is below the rams 10 when the replacement shoes are to be installed. The rams 10 are closed about the cutter body 40. Upon the drill string being raised, the spring loaded positioning ring 52 contacting the rams 10 is forced downwardly on the cutter housing 48 exposing the apertures 49 and, in the embodiment of FIGS. 14 and 15, the flushing port 45. The positioning ring 52 shoulders on a stop and tension is taken in the drill string. Fluid in the drill string, with the embodiment of FIGS. 14 and 15, passes through the flushing fluid passage 57, out through the flushing port 45, signalling proper positioning of the assembly. This positions the drill pipe ram grip 46 opposite a gripping ram which is then closed to engage the ram grip 46. Upon release of tension in the drill pipe the cutter assembly is supported by the ram grip 46 which is engaged by the lower surface of the locator ring 43. As previously explained the cutter body 40 can now be slowly rotated at the same time as hydraulic pressure is supplied down the drill pipe to force the actuating piston 54 downwardly whereby the cutter blades 50 are urged outwardly to remove the packing seal from the recess 16 of the blow out preventer ram 10. Flushing liquid passed down the outside of the drill pipe of the embodiment of FIG. 7 causes the seal debris to be collected in the collection ports 53. In the embodiment of FIGS. 14 and 15 the hydraulic fluid passing down the inside of the drill pipe under pressure goes out through the flushing port 45 removing the cuttings of the ram packing seal material. Much of the debris not carried to the surface in the flushing fluid is collected in the collection ports 53.

The cutter assembly is removed from the well head and replaced on the drill string by the installation assembly of FIG. 8 with the replacement shoes 13 held in position on the shoe tray 70 by means of shear pins engaging in shear pin holes 94 of the tray and shear pin holes 15 of the shoes. The vertical spacing between the annular blow out preventer rest 61, the drill pipe ram grip l62 and the shoe tray 70 are maintained in a predetermined axial spacing whereby when the drill pipe ram grip 62 is aligned with the gripping rams, the replacement shoes 13 will be properly aligned at the same vertical height as the blow out preventer rams.

The installation assembly is lowered until the blow out preventer rest 61 rests upon the top of the packing element of an annular blow ot preventer at the well head, the blow out preventer rest 61 being so mounted on the installation body 60 as axially to position the drill pipe grip 62 relative to the positioning rams and the replacement shoes 13 to the rams 10. The gripping rams at the well head are then closed upon the drill pipe ram grip 62 which is of a larger diameter than the inside diameter of the rams whereby upon closing of the gripping rams two gaps are provided therebetween on diametrically opposite sides of the installation body 60. The body 60 is then rotated slowly until the indexing stubs are aligned with the gaps between the gripping rams whereupon the spring 66 biases the indexing stubs 78 up into these gaps at which time the installation body 60 is properly angularly orientated relative to the gripping rams. This vertical movement of the stubs past the outer periphery of the ram grip 62 is permitted since by this time the diameter of the ram grip is reduced due to the compression exerted thereon by the gripping rams.

Vertical movement of the ring 76 exposes the ports 80 to provide a hydraulic signal indicating that the body 60 is properly angularly orientated with the replacement shoes 13 aligned with the blow out preventer rams 10. The blow out preventer rams can now be actuated to be urged against the replacement shoes 13 supported by the tray 70. As the rams move into engagement with the replacement shoes the shoe tray is displaced downwardly against the action of spring 72 by the blow out preventer rams 10 engaging the sloping upper surfaces of the tray 70.

With the embodiment of FIG. 11, because the surface 92 has a greater radius of curvature than the inner surface of the replacement shoes 13 the shoe locking pins 19 which have been pre-installed in the replacement shoes 13 keep in their withdrawn position while the tapered orientation projections engage in the conical recesses in the rams 10. Upon disengagement of the drill pipe gripping rams from the drill pipe ram grip 62 the installation body 60 can be lowered so that the replacement shoes 13 are held stationary by the blow out preventer rams 10 while the installation body 60 descends, the shear pins holding the replacement shoes 13 on the shoe tray 70 having been sheared. When the replacement shoes reach the necked portion of the installation body 60 the rams together with the replacement shoes are moved further inwardly until the ends of the locking pins engage the lower end of the tapered surface 90 and then, upon further movement of the installation body 60 downwardly while the replacement shoes are kept in position, the tapered surface 90 causes the locking pins 19 to be forced outwardly until they are retained in position locking the shoes in the rams 10 upon expansion of the snap rings 33. Maximum force is applied to the rams 10 driving home the replacement shoes 13 and the locking pins 19. Continued movement of the installation body 60 downwardly causes the shoe securing pins 68 to be received within the holes 18 and 41, rotation of the drill pipe, and thus of the installation body 60, causing release of the securing pins 68 from the stop ring 67 to complete mounting of the replacement shoes 13 on the rams 10. Upon full retraction of the rams the installation assembly can then be drawn up from the well head.

Instead of having the cylindrical portion 92 with a radius of curvature larger than the internal surface of the replacement shoe the mandrel 90 can have a diameter having a slightly smaller radius of curvature than the internal surface of the replacement shoe. With this arrangement once the tapered orienttion projections have engaged in the conical recesses in the rams 10 to give detailed orientation, further closing of the rams 10 compresses the replacement shoes 13 about the surface of the mandrel which is slightly smaller in radius of curvature than the inside of the replacement shoe. Shoe locking pins which have been pre-installed in the replacement shoes bear against the surface of the mandrel 90 and are driven into the locking pin holes in the rams 10 by projection of the rams rather than by use of the tapered surface as described above.

With the embodiment of FIG. 13 the tapered mandrel 90 does not have a lower cylindrical portion 92. The outside diameter of the split shoe compression ring 74 when extended is greater than the inside diameter of the replacement shoes 13. Because the shoe locking pins 19 have been pre-installed in the replacement shoes 13 and through the shoe compression ring 74 the shoes keep in their position while the tapered orientation points 34 of the shoes engage the conical orientation recesses 31 of the rams. This provides detailed alignment of the shoes and rams. Closing of the rams 10 compresses the shoes against the compression ring 74 forcing the locking pins 19 partway into the rams 10, breaking the shear pins and forcing the replacement shoes 13 against the outside of the shoe compression ring. The locking pins 19 are secured in position by the snap rings 33. The tapered mandrel 90 is used as part of the installation body 60 above the shoe compression ring 74 and may further be employed to drive home the locking pins 19 when the entire assembly is lowered against the taper after an initial retraction of the rams to extract the pins 19 from the compression ring 74 which itself remains supported by the tray 70.

Movement of the installation body downward causes the shoe securing pins 68 to move downwardly to be received within the shoe securing pin holes 18 and 41 this movement being continued until snap rings carried by the pins 68 lock the pins in place. Rotation of the drill pipe, and thus also of the installation body 60, causes the release of the securing pins 68 from the spring stop 67 to complete mounting of the replacement shoes 13 on the rams 10. Upon full retraction of the rams the installation assembly can be drawn from the well head.

An alternative method of conveying and positioning the locking pins 19 through the replacement shoes 13 to attach the shoes to the rams 10 is demonstrated in FIGS. 16 and 17. This employs the use of cartridges 25 and expanding gas as the driving force.

The shoe compression ring 74 is replaced with a percussion ring 75 in which have been placed cartridges 25 and firing pins 24. The outside diameter of the percussion ring 75 conforms to the inside diameter of the replacement shoes 13 and the rings jointly carry the percussion locking pins 23.

The closing of the rams 10 against the spring loaded shoe tray 70 and the orientation points 34 engaging the conical orientation recesses 31 establishes vertical and axial alignment of the rams 10 and the replacement shoes 13. The compression of the percussion ring 75 against the installation body 60 forces the firing pins 24, which protrude from the inside of the percussion ring 75, against the cartridge 25 causing it to detonate. The expansive gases from the detonation force the percussion locking pin 23 into the ram 10 securing the replacement shoes 13 to the rams 10. The snap ring 33 expanding in the counter bore 21 (FIG. 1) secures the percussion locking pins 23 in place.

Preferably a basket, now shown, is suspended below the ram shoe installation assembly in order that should there be any accidental dropping of components from the installation assembly they can be simply collected by withdrawal of the installation assembly from the well head.

While generally I have referred to the blow out preventer ram sealing with the outer surface of drill pipe it will be appreciated that in many instances they will be used to seal with the outer surface of casing being fed into the well.

I have referred above to a blow out preventer assembly where a change in the pipe ram size is confined to a unit in the lower portion of the assembly of blow out preventers. With a rearrangement of the components described above and employing the same vertical and axial orientation techniques ram sizes could be remotely altered to units in the upper portion of the blow out preventer assembly. Also the employment of this technique is not confined to operation on ram blow out preventers exclusively but could encompass similar remote orientation technique to apparatus which, for example, is in the form of drilling and production well head components and casing and tubing landing devices and well head production testing assemblies.

As will be appreciated a further broad inventive concept disclosed herein is that of using rapidly expanding gas, for example from a cartridge, as a driving medium for securing components of well head assemblies to basic units at remote locations.

I claim:

1. Apparatus to be suspended from the lower end of a drill pipe string for indexing and mounting a blow out preventer receiving shoe on a blow out preventer ram, such apparatus comprising an installation body adapted to be secured to the lower end of the drill pipe string, means for supporting a replacement shoe in a predetermined position on the body, means carried by the installatin body for indexing the shoe support means relative to a drill pipe ram grip during used of the apparatus by being received between the ends of the rams of a partly open drill pipe grip, and means for engaging the replacement shoe with a blow out preventer ram.

2. Apparatus according to claim 1, wherein the indexing means comprises an indexing assembly including stubs adapted to be received between the ends of the rams of a drill pipe ram grip in an indexing position.

3. Apparatus according to claim 2, including spring biasing means urging the stubs axially towards the indexing position.

4. Apparatus according to claim 1, wherein the supporting means comprises a tray member carried by the installation body, the shoe being securable to the tray member by shear pins.

5. Apparatus according to claim 4, wherein the tray has a sloping support surface adapted to cam the tray radially downwardly upon engagement by a blow out preventer ram upon radial movement of the ram inwards towards the shoe.

6. Apparatus according to claim 1, wherein secring pins are carried by the shoe and the installation body is provided with a tapered surface for driving said securing pins radially outwardly through the shoe into holes in the blow out preventer ram upon axial movement of the installation body relative to the shoe.

7. Apparatus according to claim 1, including securing pins and wherein the installation body has means suporting said securing pins axially for receipt in holes extending axially through the shoe and blow out preventer ram.

8. Apparatus according to claim 1, including a compression ring supported by the installation body radially inwardly of the shoe, whereby the shoe may be presses against the compression ring by a blow out preventer ram upon installation of the ram to the shoe.

9. Apparatus according to claim 1, including a percussion ring mounted within the shoe, radially movable securing pins securing the ring to the shoe, and gas generating means for driving the pins radially outwardly to secure the shoe to the ram during use of the apparatus to fit a replacement shoe on a blow out preventer ram.

10. Apparatus for working in a well head having a closing unit provided with an end surface and a ram having an indexing space extending axially thereof, such apparatus comprising a support body, means for suspending the support body from a pipe string, a flange projecting radially from the support body for engagement with said end surface of the closing unit, and means carried by the body and spring urged from a retracted position to an extended position whereby in used of the apparatus, following axial location thereof in a well head by engagement of the flange with the closing unit the apparatus can be rotated until such time as the means carried by the body is aligned to be received within said indexing space.

* * * * *